US005114490A

United States Patent [19]

Tilby

[11] Patent Number: 5,114,490

[45] Date of Patent: May 19, 1992

[54] APPARATUS FOR CONTROL OF SUGARCANE HALF-BILLETS

[76] Inventor: Sydney E. Tilby, 4688 Boulderwood Dr., Victoria, B.C., Canada, V8Y 2P8

[21] Appl. No.: 637,470

[22] Filed: Jan. 4, 1991

[51] Int. Cl.[5] ..... B02C 23/02

[52] U.S. Cl. ..... 127/2; 241/225; 241/235

[58] Field of Search ..... 127/2; 241/14, 69, 79, 241/155, 157, 235, 236, 225; 209/13; 460/24, 113, 150

[56] References Cited

U.S. PATENT DOCUMENTS

| | | | |
|---|---|---|---|
| 605,293 | 6/1898 | Madden | 241/222 |
| 608,630 | 8/1898 | Wright | 241/222 |
| 616,177 | 12/1898 | Adelsperger | 241/222 |
| 623,753 | 3/1899 | Winchell | 241/222 |
| 623,754 | 3/1899 | Winchell | 241/222 |
| 627,882 | 6/1899 | Sherwood | 241/222 |
| 632,789 | 9/1899 | Remy | 241/222 |
| 657,341 | 9/1900 | Dyer | 241/222 |
| 670,037 | 3/1901 | Sherwood | 241/222 |
| 675,758 | 6/1901 | Sherwood | 241/222 |
| 684,492 | 10/1901 | Adamson | 241/222 |
| 707,531 | 8/1902 | Adamson | 241/222 |
| 1,689,387 | 10/1928 | Heimlich | 241/222 |
| 2,706,312 | 4/1955 | Bobkowicz | 19/7 |
| 3,424,611 | 1/1969 | Miller | 127/2 |
| 3,424,612 | 1/1969 | Miller | 127/2 |
| 3,464,877 | 9/1969 | Miller et al. | 156/259 |
| 3,464,881 | 9/1969 | Miller et al. | 161/60 |
| 3,566,944 | 3/1971 | Tilby | 146/222 |
| 3,567,510 | 12/1967 | Tilby | 99/2 ND |
| 3,567,511 | 3/1971 | Tilby | 127/43 |
| 3,690,358 | 9/1972 | Tilby | 146/119 |
| 3,698,459 | 10/1972 | Tilby | 146/119 |
| 3,721,567 | 3/1973 | Miller et al. | 127/42 |
| 3,796,809 | 3/1974 | Miller et al. | 426/2 ND |
| 3,873,033 | 3/1975 | Tilby | 241/19 |
| 3,976,498 | 8/1976 | Tilby et al. | 127/2 |
| 3,976,499 | 8/1976 | Tilby | 127/42 |
| 4,025,278 | 5/1977 | Tilby | 425/404 |
| 4,151,004 | 4/1979 | Vukelic | 127/2 |
| 4,312,677 | 1/1982 | Tilby et al. | 127/2 |
| 4,572,741 | 2/1986 | Mason | 127/2 |
| 4,636,263 | 1/1987 | Cundiff | 127/42 |
| 4,702,423 | 10/1987 | Pinto | 241/60 |
| 4,743,307 | 5/1988 | Mason | 127/2 |
| 4,816,075 | 3/1989 | Gruenewald | 127/2 |

*Primary Examiner*—Theodore Morris
*Assistant Examiner*—Patricia L. Hailey
*Attorney, Agent, or Firm*—Jansson & Shupe, Ltd.

[57] ABSTRACT

An improved half-billet control device in apparatus for separating sugarcane (or the like) into constituent parts and an improved method for half-billet control. The device has a rotatable gide roll in proximity to a planar slide and transverse to the direction of half-billet movement. The guide roll has annular flexible projections, preferably bristle rows, which are parallel to the direction of half-billet movement, perpendicular to the slide, and spaced apart by a distance substantially less than the average billet diameter. Half billets moving along the slide nestle between projections and are thereby reoriented as needed to align their longitudinal axes parallel to the direction of movement.

15 Claims, 2 Drawing Sheets

APPARATUS FOR CONTROL OF SUGARCANE HALF-BILLETS

FIELD OF THE INVENTION

This invention is related generally to processing of sugarcane, sweet sorghum and the like and, more particularly, to the separation of such plants into their constituents.

BACKGROUND OF THE INVENTION

General Background

The stalk of the sugarcane plant includes an outer rind which is a hard, wood-like fibrous substance. The rind surrounds a central core of pith, which bears nearly all of the sugar juice from which various sugar products are made. The outer surface of the rind has a thin, waxy epidermal layer, referred to herein as "dermax."

Certain other plants (e.g., sweet sorghum) are similar to sugarcane in that they are grasses having woody grass stalks. While there is frequent reference herein to sugarcane, it is to be understood that this invention applies to processing of woody grass stalks like sugarcane and sweet sorghum or certain of their constituents. At no point, including the claims, is any reference to sugarcane to be limiting.

Conventional sugarcane industry practices until today have utilized sugarcane primarily only for its sugar content. Such industry practices have involved chopping and crushing sugarcane stalks to remove the sugar juice, with the waste solids (bagasse) being used primarily only as fuel, mainly in sugar production operations.

Although such practices have been virtually uniform throughout the industry, it has been recognized that a number of very useful products may be produced from sugarcane if the sugarcane stalk is first separated into its rind, pith and dermax constituents. The many useful end-products made possible by such separation can provide great economic benefit. Such separation also provides significant efficiencies in the production of sugar.

Earlier efforts involving stalk separation, though not necessarily related to sugarcane, are reflected in the following United States patents:

605,293 (Madden)
608,630 (Wright)
616,177 (Adelsperger)
623,753 (Winchell)
623,754 (Winchell)
627,882 (Sherwood)
632,789 (Remy)
657,341 (Dyer)
670,037 (Sherwood)
675,758 (Sherwood)
684,492 (Adamson)
707,531 (Adamson)
1,689,387 (Heimlich)
2,706,312 (Bobkowicz).

Even though stalk separation efforts began as early as the late 1800's, essentially the entire sugarcane industry continued in the conventional process noted above, involving chopping and crushing of the whole stalk to extract sugar juice.

Technology in this field remained rather dormant until the 1960's, when a resurgence of development activity began, substantially all related to what has been known in the industry as the Tilby system, a cane separation system named after the principal originator, Sydney E. ("Ted") Tilby.

Broadly speaking, the Tilby system includes a multistep operation executed by various portions of a cane separator machine. Sugarcane billets, i.e., cut lengths of cane stalk preferably about 25–35 cm long, are driven downwardly over a splitter to divide them lengthwise into semi-cylindrical half-billets. The two half-billets of a split billet are then processed individually by symmetrical downstream portions of the separator machine.

The first of such downstream portions of the separator is a depithing station which includes a cutter roll and holdback roll for milling pith away from the rind of the half-billet while simultaneously flattening the rind. The next downstream portion is a dermax removal station from which the rind emerges ready for subsequent processing in a variety of ways, including slitting, chipping and/or many other processing steps. The pith is conveyed away from the separator machine to an extraction station where its sugar juice is removed.

A significant number of patents related to the Tilby system and improvements in such system have been granted, beginning in the 1960's. These and other fairly recent United States patents related generally to sugarcane processing are as follows:

3,424,611 (Miller)
3,424,612 (Miller)
3,464,877 (Miller et al.)
3,464,881 (Miller et al.)
3,566,944 (Tilby)
3,567,510 (Tilby)
3,567,511 (Tilby)
3,690,358 (Tilby)
3,698,459 (Tilby)
3,721,567 (Miller et al.)
3,796,809 (Miller et al.)
3,873,033 (Tilby)
3,976,498 (Tilby)
3,976,499 (Tilby)
4,025,278 (Tilby)
4,151,004 (Vukelic)
4,312,677 (Tilby et al.)
4,572,741 (Mason)
4,636,263 (Cundiff)
4,702,423 (Pinto)
4,743,307 (Mason)
4,816,075 (Gruenewald).

The Tilby system, when finally fully commercialized, can provide substantial outputs of several high-value products. This greatly increases cash yields per ton of sugarcane, a factor of significant importance to an industry in which profitability in recent years has been marginal at best. This is important generally, but is of particular importance to the many developing countries in which a flourishing sugarcane industry would be a boon to economic growth and stability.

Considering that sugarcane is one of the most rapidly growing, easily developed, and readily accessible sources of biomass, full commercialization of the Tilby system can significantly reduce dependence on forests and on certain other crops and resources. Among the products which can be made from sugarcane constituents separated by the Tilby system are sugar in an increased variety of forms, foods and food additives, animal feeds, a variety of wood products and building materials, alcohol for a variety of purposes, paper and other pulp-containing products, and a variety of specialty products.

While substantial technical development has occurred over a period of many years with respect to the Tilby system, a number of difficult and critical problems have remained. The failure to overcome such problems has prevented full commercialization of the Tilby system. The invention described and claimed herein is directed to the solution of certain of these problems.

SPECIFIC BACKGROUND

Efficient operation of the Tilby system requires proper operation of the depithing station. In order for the depithing station to operate efficiently it is imperative that half-billets enter the nip of the cutter and hold-back rolls at such station in proper alignment, that is, with their longitudinal axes parallel to the direction of movement and at right angles to the cutter roll axes. Proper orientation ensures optimal pith removal and facilitates full realization of the benefits associated with the Tilby system.

Misalignment of sugarcane half-billets moving between the splitter and the depithing station is prone to occur for a number of reasons, including variance in the angle of entry of billets over the splitter, variance in billet diameter, length, and toughness, and the varying and often very large quantity of billets flowing over the splitter toward the depithing station. Such half-billet movement in Tilby system apparatus is, of course, primarily along a slide surface extending downwardly from the splitter blade edge toward the depithing station.

Various efforts have been made to control the orientation of half-billets, but none of these has shown itself fully satisfactory, particularly for large-scale commercial equipment having a substantial throughput rate. And, some prior attempts at orientation control have caused other problems to arise.

One approach has involved the use of one or more rubber-covered control rolls which are spaced slightly apart from the slide and rotate at a rate just exceeding that of the feed rolls above the splitter. Examples of such control rolls are seen in U.S. Pat. Nos. 3,567,510 (Tilby) and 3,567,511 (Tilby).

While such rolls serve a purpose, they provide only limited control. Such control rolls tend to maintain the orientation of properly oriented half-billets, but have only limited value in re-aligning half-billets received from the splitter in misaligned orientations. Generally speaking, such misalignment continues.

Another significant problem with such control rolls is that they can require mechanical adjustment to accommodate cane from batches of having billets of varying average diameters. Of course, every batch of sugarcane billets has a range of billet diameters, and an average diameter. But cane from different parts of the world, or cane grown under widely varying conditions, can have average diameters over a range large enough that a single spacing could not easily accommodate cane for all sources.

Another approach which has been tried to control the orientation of half-billets is disclosed in U.S. Pat. No. 3,976,498 (Tilby et al.) This involves the use of a coacting pair of feed rolls located at the end of the aforementioned slide. This approach has been less than satisfactory, for a number of reasons.

Foremost among these is the fact that, as in such patent disclosure, there may be nothing provided before such coacting rolls to impose control on the half-billets falling from the splitter blade. Another possible problem, particularly if undue pressure is applied on the half-billets by the coacting rolls, is a possible loss of sugarcane juice at a point which such extraction is not intended.

Perhaps the most significant drawback, however, is that, as with other control devices, such coacting rolls are essentially incapable of reoriented half-billets which reach them in a condition of misorientation. Such device failed to adequately solve the problems which this invention addresses. Misalignment was still common, resulting in inefficiency.

In summary, there is a significant need for an improved half-billet control apparatus, to facilitate commercialization of high-throughput sugarcane separation systems.

OBJECTS OF THE INVENTION

It is an object of this invention to provide an improved means for half-billet control in a sugarcane separation system, overcoming the problems of the prior art, including those mentioned above.

Another object of this invention is to provide a half-billet control device which can reorient misaligned half-billets between the splitter and the depithing station.

Another object of this invention to provide an improved guide roll apparatus for half-billets such that half-billets are aligned properly and maintained in proper alignment for optimum pith and dermax removal.

Another object of this invention to provide an improved guide roll apparatus for half-billets which is self-adjusting to compensate for half-billets of varying diameters.

Yet another object of this invention to provide an improved guide roll apparatus for half-billets which is durable and inexpensive.

These and other important objects will be apparent from the descriptions of this invention which follow.

SUMMARY OF THE INVENTION

This invention is an improvement in sugarcane separation apparatus of the type having billet feed means, a blade onto which billets are driven by the feed means to form half-billets, a substantially planar slide extending from the blade, and rolls means adjacent to the slide for controlling half-billet movement toward a depithing station. The improvement relates to the roll means for half-billet control. The invention overcomes certain well-known problems and deficiencies, including those outlined above.

This invention includes a guide roll, adjacent to the aforementioned slide, having an arrangement of flexible, resilient projections which interact with misaligned half-billets reorient them so that they enter the depithing station longitudinally. The projections preferably include flexible bristle rows which allow half-billets to nestle therebetween as the brush roll rotates. While bristle rows are highly preferred, spaced annular rubber ridges or the like may be used instead.

More specifically, this invention includes at least one half-billet guide roll which is one rotatably mounted in proximity to the slide and is transverse to the direction of billet movement. Each such guide roll has annular flexible projections which are substantially parallel to the direction of half-billet movement, substantially perpendicular to the slide, and spaced from one another by a distance substantially less than the average billet diameter.

In preferred embodiments, each such guide roll has a core from which the projections in the form of bristle rows extend, such bristles terminating in bristle tips. preferably substantially greater than the average billet radius, and the distance between the slide and the bristle tips at their closest position to the slide is substantially less than the average billet radius. In highly preferred embodiments, the bristle height is substantially greater than the average billet radius.

Such dimensions allow the aforementioned nestling and reorientation of misaligned half-billets passing such guide rolls. Such dimensions also very readily serve to maintain half-billets in the proper orientation as they move along toward the depithing station.

In preferred embodiments, the whole-billet feed means is a pair of driven coacting feed rolls, and the guide roll or rolls are driven at a linear speed exceeding the linear speed of the feed rolls. It is also preferred to have two guide rolls of the type described spaced along the slide.

As already noted, the Tilby sugarcane separation system has a number of advantages over the old-style method and apparatus for processing sugarcane and the like. The improvement of this invention outlined above allows these advantages to be realized in high-throughput commercial equipment. Half-billet processing can proceed efficiently and effectively.

The unique guide-roll configuration of this invention allows such roll to be spaced at a distance from the slide which allows control and reorientation of half-billets having a wide range of diameters, so that adjustments are not essential.

The nature of the guide rolls assures that little or no sugar juice will be extracted from the half-billets has they move from the splitter blade to the depithing station, even though control is greatly enhanced.

The advantages of this invention are most pronounced in large, high-volume separation equipment, since such blade. Proper half-billet orientation is secured and maintained over the course of half-billet movement along such longer slide, even with increased half-billet flow.

DETAILED DESCRIPTIONS OF PREFERRED EMBODIMENTS

Figure 1:
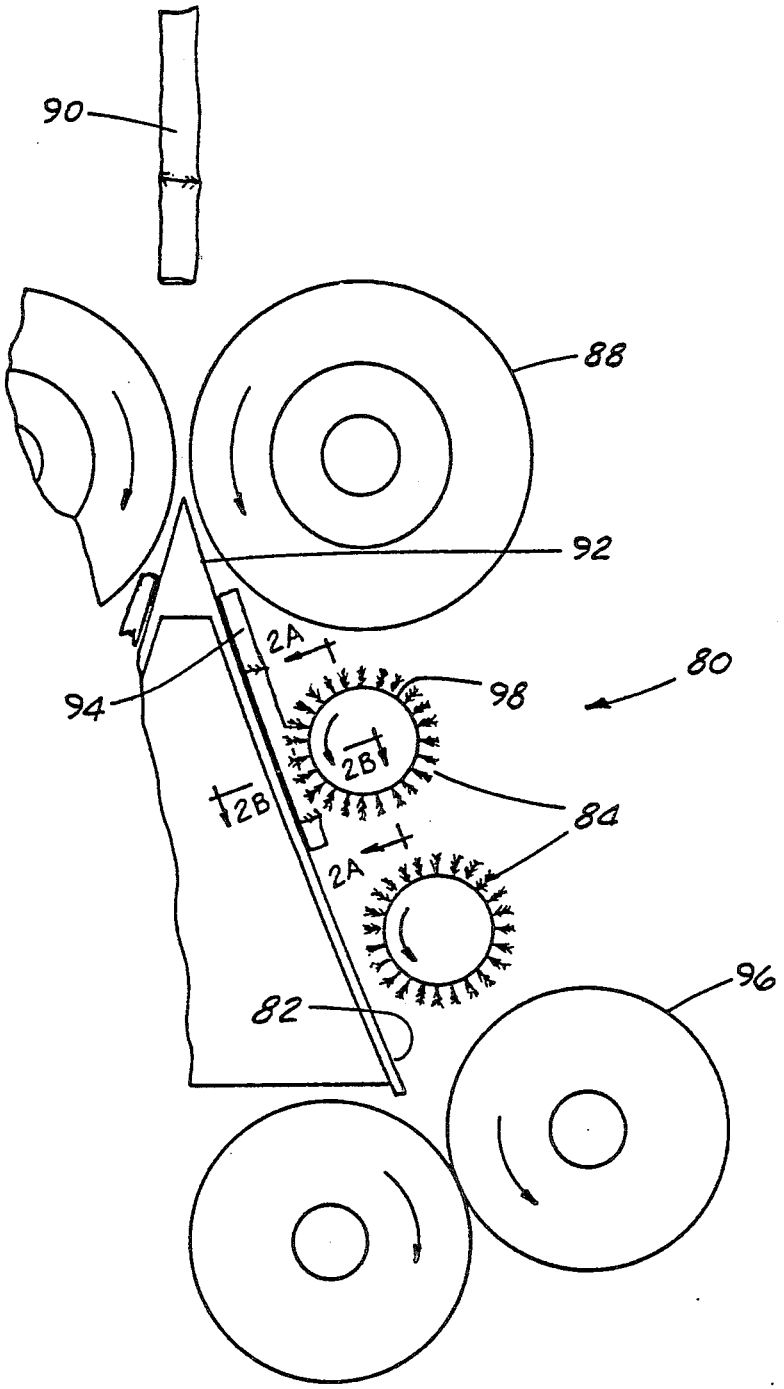
FIG. 1 is a schematic elevation view of sugarcane separation apparatus including the improved guide roll device of this invention.

The drawings illustrate an improved guide roll apparatus 80 which is a preferred embodiment of this invention. Guide roll apparatus 80 includes a unique roll-slide combination, including slide 82 and brush rolls 84 which have bristle rows 86 attached thereto Brush rolls 84, which are rotatably driven by shafts 85, are positioned downstream from feed rolls 88 which drive sugarcane billets 90 over blade 92 to split them into half-billets 94. Each half-billet 94 proceeds downstream along slide 82 toward depithing rolls 96. Brush rolls 84 are rotated at a rate such that the linear speed of the bristle tips is slightly greater than the linear speed of feed rolls 88.

Figure 2A:
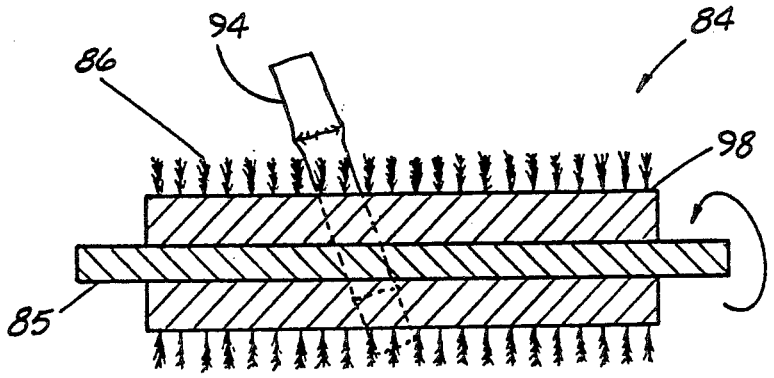
FIG. 2A is a fragmentary sectional view (without background) showing the guide roll of FIG. 1, taken all section 2A—2A as indicated in FIG. 1.

A sugarcane half-billet which is misaligned with respect to its direction of movement, as shown in FIG. 2A, is reoriented by the action of rotating brush roll 84. Annular bristle rows 86 guide sugarcane half-billets into proper directional alignment. This is accomplished by the manner in which the half-billets nestle in the bristle portion of brush roll 84.

Figure 2B:
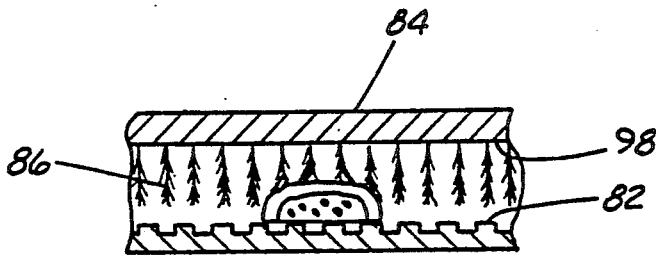
FIG. 2B is a sectional view (without background) taken along section 2B—2B as indicated in FIG. 1.

As best shown in FIG. 2B, the distance between slide 82 and core 98 of brush roll 84 is substantially greater than the average billet radius. In addition, the distance between slide 82 and the tips of bristle rows 86 at their closest position to slide 82 is substantially less than the average billet radius. Further, the height of bristles rows 86 is substantially greater than the average billet radius, and the distance between bristle rows is substantially less than the average billet radius. This dimensioning is highly preferred and is helpful to the billet-reorienting ability of this invention.

Brush rolls 84, the bristles, and slide 82 may be made using a variety of parts and materials. Acceptable choices will be apparent to those skilled in the art who are made aware of this invention.

As noted above, while brush bristle rows as annular flexible projections are effective in controlling and reorienting half-billets, other annular projections can be used. One acceptable choice involves space resilient rubber rings. Materials other than rubber and a variety of specific shapes may be used.

While the principles of this invention have been described in connection with specific embodiments, it should be understood clearly that these descriptions are made only by way of example and are not intended to limit the scope of the invention.

I claim:

1. In sugarcane separation apparatus having means to feed billets onto and over a blade to form half billets, a substantially planar slide extending from the blade in a first direction toward a depithing means, and roll means upstream of the depithing means and adjacent to the slide for half-billet control, the improvement wherein the roll means comprises:

at least one rotatably-mounted billet guide roll in proximity to the slide and transverse to the first direction, the guide roll having annular flexible projections substantially parallel to the first direction, substantially perpendicular to the slide, and spaced apart by a distance substantially less than the average billet diameter, whereby half billets moving along the slide nestle between projections and are thereby oriented and reoriented as necessary to align their longitudinal axes parallel to the first direction.

2. The apparatus of claim 1 wherein the annular projections are bristle rows.

3. The apparatus of claim 2 wherein the guide roll has a core from which the bristles extend to terminate in bristle tips, and wherein:

the distance between the slide and the guide roll core is substantially greater than the average billet radius; and the distance between the slide and the bristle tips at their closest position to the slide is substantially less than the average billet radius.

4. The apparatus of claim 3 wherein the bristle height is substantially greater than the average billet radius.

5. The apparatus of claim 1 further comprising means to rotate the guide roll.

6. The apparatus of claim 5 wherein the annular projections are bristle rows.

7. The apparatus of claim 6 wherein the guide roll has a core from which the bristles extend to terminate in bristle tips, and wherein:

the distance between the slide and the guide roll core is substantially greater than the average billet radius; and the distance between the slide and the bristle tips at their closest position to the slide is substantially less than the average billet radius.

8. The apparatus of claim 7 wherein the bristle height is substantially greater than the average billet radius.

9. The apparatus of claim 5 wherein the means to feed are feed rolls driven at a first linear speed and the means to rotate the guide roll drives the guide roll at a linear speed in excess of the first linear speed.

10. The apparatus of claim 1 having a pair of such guide rolls spaced along the slide.

11. The apparatus of claim 10 further comprising means to rotate the guide roll.

12. The apparatus of claim 11 wherein the means to feed billets are feed rolls driven at a first linear speed and the means to rotate the guide roll drives guide roll at a linear speed in excess of the first linear speed.

13. The apparatus of claim 12 wherein the annular projections are bristle rows.

14. The apparatus of claim 13 wherein the guide roll has a core from which the bristles extend to terminate in bristle tips, and wherein:

the distance between the slide and the guide roll core is substantially greater than the average billet radius; and the distance between the slide and the bristle tips at their closest position to the slide is substantially less than the average billet radius.

15. The apparatus of claim 14 wherein the bristle height is substantially greater than the average billet radius.

* * * * *